US009376294B2

(12) United States Patent
Fetters, III et al.

(10) Patent No.: US 9,376,294 B2
(45) Date of Patent: Jun. 28, 2016

(54) BRAKE, SHEAR AND CABLE MANAGEMENT SYSTEM AND METHOD

(71) Applicant: Absolute Oilfield Equipment, LLC, Tulsa, OK (US)

(72) Inventors: Frank Fetters, III, Mustang, OK (US); Mark Dunbar, Tulsa, OK (US)

(73) Assignee: Absolute Oilfield Equipment, LLC, Tulsa, OK (US)

( * ) Notice: Subject to any disclaimer, the term of this patent is extended or adjusted under 35 U.S.C. 154(b) by 213 days.

(21) Appl. No.: 13/958,982

(22) Filed: Aug. 5, 2013

(65) Prior Publication Data

US 2014/0034887 A1 Feb. 6, 2014

Related U.S. Application Data

(60) Provisional application No. 61/742,147, filed on Aug. 4, 2012.

(51) Int. Cl.

| | |
|---|---|
| ***B66F 1/00*** | (2006.01) |
| ***B66D 1/28*** | (2006.01) |
| ***B66D 1/82*** | (2006.01) |
| ***E21B 29/04*** | (2006.01) |

(52) U.S. Cl.
CPC .. *B66D 1/28* (2013.01); *B66D 1/82* (2013.01); *E21B 29/04* (2013.01)

(58) Field of Classification Search
CPC ..... B66D 1/28; B66D 1/38
See application file for complete search history.

(56) References Cited

U.S. PATENT DOCUMENTS

| | | | | |
|---|---|---|---|---|
| 1,876,954 | A | | 9/1932 | Johnson |
| 1,935,585 | A | | 11/1933 | Tornblom |
| 2,247,795 | A | | 7/1941 | Whitcomb |
| 2,593,993 | A | * | 4/1952 | Dahl et al. ..... 83/308 |
| 2,660,382 | A | | 11/1953 | Wilson |
| 2,904,284 | A | | 9/1959 | Newsom |
| 2,941,746 | A | | 6/1960 | Hunt |
| 3,010,351 | A | * | 11/1961 | Firing ..... 83/255 |
| 3,066,917 | A | | 12/1962 | Tuplin et al. |
| 3,095,183 | A | | 6/1963 | Le Bus, Sr. |
| 3,222,057 | A | * | 12/1965 | Couri ..... 271/3.18 |
| 3,309,066 | A | | 3/1967 | Carlson |
| 3,467,360 | A | | 9/1969 | Mizell |
| 3,490,128 | A | * | 1/1970 | Giannelli et al. ..... 53/331 |
| 3,738,614 | A | | 6/1973 | Peterson |
| 3,951,355 | A | * | 4/1976 | Morioka et al. ..... 242/477.3 |
| 4,078,634 | A | | 3/1978 | Thomas |
| 4,103,745 | A | | 8/1978 | Varich |
| 4,227,680 | A | | 10/1980 | Hrescak |

(Continued)

OTHER PUBLICATIONS

Baker, Ron, A Primer of Oilwell Drilling, Fourth Edition, Petroleum Extension Service, 1979.

(Continued)

*Primary Examiner* — Emmanuel M Marcelo
(74) *Attorney, Agent, or Firm* — Head Johnson & Kachigian, P.C.

(57) ABSTRACT

A brake, shear and cable management system and method, which is attachable adjacent to a reeling-type drum to effectively brake and cut cable, such as drilling line, boring line, electrical line, fiber optic line or the like. The brake, shear and cable management system includes a cable management assembly, a cable brake assembly and a cable cutting assembly used in conjunction to manage, retain and sever a spent portion of cable upon the drum.

54 Claims, 9 Drawing Sheets

(56) References Cited

U.S. PATENT DOCUMENTS

| | | | | |
|---|---|---|---|---|
| 4,275,803 | A | 6/1981 | Putney | |
| 4,369,576 | A | 1/1983 | McVaughn | |
| 4,611,787 | A | 9/1986 | May | |
| 4,738,312 | A | 4/1988 | Wittrisch | |
| 4,767,073 | A | 8/1988 | Malzacher | |
| 4,923,005 | A | 5/1990 | Laky et al. | |
| 5,141,085 | A | 8/1992 | McCormick | |
| 5,330,122 | A | 7/1994 | Wood | |
| 5,853,118 | A | 12/1998 | Avakov | |
| 6,070,285 | A * | 6/2000 | Geppert | 15/104.061 |
| 6,182,945 | B1 | 2/2001 | Dyer | |
| 6,230,955 | B1 | 5/2001 | Parks | |
| 6,349,474 | B1 | 2/2002 | Jordan | |
| 7,134,374 | B1 | 11/2006 | Williamson | |
| 7,210,670 | B2 | 5/2007 | Franks | |
| 7,419,137 | B2 | 9/2008 | Boon | |
| 7,963,319 | B2 | 6/2011 | Daigle | |
| 8,079,569 | B2 | 12/2011 | Lesko | |
| 2007/0119997 | A1 | 5/2007 | Boon | |
| 2011/0037040 | A1 | 2/2011 | Hess | |
| 2011/0147008 | A1 * | 6/2011 | Brown | 166/377 |

OTHER PUBLICATIONS

Coiled Tubing Technical Advances Cut Operational Costs Sharply, Drilling Contractor, Jul./Aug. 2005.

* cited by examiner

BRAKE, SHEAR AND CABLE MANAGEMENT SYSTEM AND METHOD

CROSS REFERENCE TO RELATED APPLICATIONS

This application claims the benefit of U.S. Provisional Patent Application Ser. No. 61/742,147, entitled "Brake, Shear and Cable Management System for a Drawworks Assembly," filed Aug. 4, 2012, which is incorporated herein by reference in its entirety.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

REFERENCE TO A SEQUENCE LISTING, A TABLE, OR A COMPUTER PROGRAM LISTING APPENDIX

Not Applicable.

BACKGROUND OF THE INVENTION

1. Field of the Invention

This invention relates generally to a brake, shear and cable management system and method, and in particular to a brake, shear and cable management system attachable adjacent to a rotatable drum and having a cable management assembly, a cable brake assembly and a cable cutting assembly used in conjunction to manage, retain and sever a spent portion of cable upon the drum.

2. Description of the Related Art.

The major components of a drilling rig hoisting system consists of a mast or derrick, a crown block, a traveling block, wire rope and a drawworks. The drawworks is used to lift or lower the drill pipe assembly into or out of the hole being drilled. The drawworks is essentially a large winch, having a drum to spool (wrap) or unwrap wire rope for the purpose of lifting or lowering the drill pipe assembly. Thus, the drum is able to rotate in either direction and is controlled and powered by a drive motor.

The wire rope is supplied to the drilling site on a large spool and is typically 1-to-2 inches in diameter. Initially, in setting-up the drilling rig, the wire rope is pulled from the supply reel through the deadline anchor and then sequentially threaded through the sheaves in the crown block and traveling block to achieve the number of lines required to support the drilling assembly planned for the wellbore. When the wire rope end has been strung over the final crown block sheave, this wire rope end is pulled down to the drawworks drum at the rig floor where it is threaded into the dogknot hole and clamped. Then the drum is rotated to pull the wire rope through this system of sheaves in order to wind-up several layers of wire rope onto the drum. The wire rope is unspooled from the supply reel. Finally, the deadline anchor is tightened, which holds the wire rope fixed at that end and then the traveling block can be raised or lowered by the rotation of the drawworks drum. The wire rope is never cut between the supply reel and the deadline anchor.

During the drilling of the wellbore, the traveling block moves up and down many times while lifting large loads (can be 250-tons or more). The wire rope bends around the sheaves and is spooled onto the drum under load many times, which causes wear. The rig crew monitors this wear using an instrument that tracks the ton-miles of use for this section of wire rope from the supply reel. When a threshold number of ton-miles has been reached (set by their cut-and-slip program for wire rope maintenance), the used section of wire rope must be retired from service.

To perform the wire rope cut and slip, the traveling block is suspended by a "hang-line" and the deadline anchor clamp is loosened. Then a predetermined number of feet of wire rope is spooled onto the drawworks drum, thereby pulling fresh unused wire rope from the supply reel and into the system of sheaves. The place where the spent wire rope is to be cut is bound with tape and cut with either a manual or hydraulic cutting tool. This is done on the rig floor. The spent wire rope is removed from the drum and rig floor and the new wire rope end is threaded through the dogknot hole and clamped. Then the drum is rotated to spool several layers of wire rope, before the deadline anchor is re-clamped. Finally the crown block hang-line is removed and drilling can resume.

It is therefore desirable to provide a brake, shear and cable management system mounted adjacent to the rotating drum in order manage, retain and sever a spent portion of cable upon the drum.

It is further desirable to provide a brake, shear and wire rope (cable) management system mounted to a drawworks housing (or rig floor) to safely and quickly move the wire rope through the crown and traveling block sheave system, clamp and cut the wire rope and control the wire rope movement and pull tension on the wire rope when spooling the drum.

It is yet further desirable to provide a brake, shear and cable management system having a cable management assembly, a cable brake assembly and a cable cutting assembly for maintenance and operation in a secure and more safe manner.

It is still further desirable to provide a brake, shear and wire rope (cable) management system that incorporates a remote wired or wireless control system that can allow the operator to be stationed in front of the drawworks drum, thereby reducing the risk of injury to rig floor personnel.

BRIEF SUMMARY OF THE INVENTION

In general, in one aspect, the invention relates to a brake, shear and cable management system attachable adjacent to a rotatable drum to manage, retain and sever a spent portion of cable. The system includes a movable truck mounted to a support structure. The support structure is constructed to laterally move the movable truck between a parked position and a refracted position and to longitudinally move the movable truck between the retracted position and an engaged position. The system also includes a cable management assembly mounted to the movable truck. The cable management assembly has a plurality of crawler assemblies with drive chains engaged with oppositely rotating gears. The gears engage gear shafts that are powered by a motor. In addition, a cable brake assembly is mounted to the movable truck, and a cable cutting assembly is also mounted to the movable truck intermediate of the cable brake assembly and the cable management assembly. The system also has a plurality of guide rollers attached to the movable truck.

The support structure of the system can include a lateral guide assembly and a longitudinal guide assembly. A truck assembly engaged with the lateral guide assembly allows for lateral movement of the movable truck between the parked position and the retracted position. The lateral guide assembly can be constructed from I-beam, square tubing, rounded tubing or the like. The longitudinal guide assembly can include powered actuators and/or screw drives, such as a motor engaged with a telescoping tube, for longitudinal movement of the movable truck between the retracted position and the engaged position. In addition, the longitudinal guide assembly can be hingedly connected to the movable truck.

The plurality of guide rollers of the system can include an upper set of guide rollers and a lower set of guide rollers separated by the cable management assembly, the cable brake assembly and the cable cutting assembly. The guide rollers can be at least one wedge roller and at least one cylindrical roller, such as a pair of cylindrical guide rollers angled in relation to the wedge roller to form a generally V-shaped opening.

The crawler assemblies of the cable management assembly can have brass or bronze U-blocks or rubber blocks attached to the drive chain. In addition, a gear reducer, a friction clutch and drive shaft couplers can be engaged with the motor, while the gears are engaged with drive shafts, which are engaged with drive sprockets, which in turn are engaged with the drive chains of the crawler assemblies. In addition, the drive shafts and/or the gear shafts can be respectively journaled in bearings mounted to the movable truck. Moreover, idler sprockets, chain tensioners and/or return sprockets can be engaged with the drive chains of the crawler assemblies.

The crawler assemblies can be constructed as a pair of opposing crawler assemblies mounted to the movable truck intermediate of the guide rollers and the cable cutting assembly, and an actuator could engage a linkage to cause one crawler assembly to move with respect to the other crawler assembly. For example, the linkage can be a four bar linkage or a linear linkage.

Additionally, the cable brake assembly can be mounted to the movable truck intermediate of the guide rollers and the cable cutting assembly, while the cable cutting assembly may be mounted to the movable truck intermediate of the cable management assembly and the cable brake assembly. The cable brake assembly can be constructed as protruding brake arms having a cable gripper, and the brake arms may be actuated by a powered screw drive journaled in bearings mounted to the movable truck. Moreover, the cable cutting assembly can be constructed as protruding cutter arms having a cable severer, which are actuated by a powered screw drive journaled in bearings mounted to the movable truck.

Figure 1:
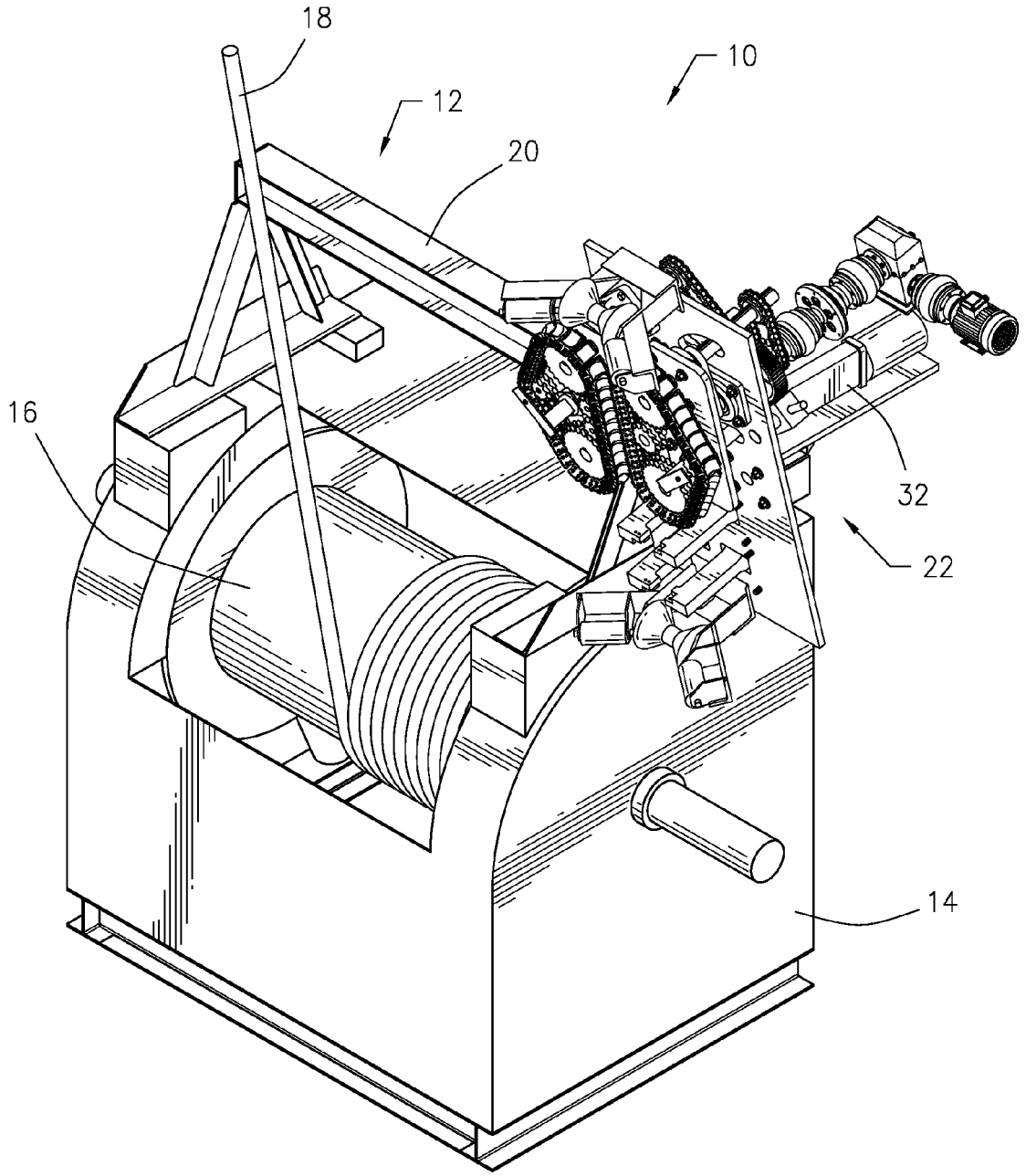
FIG. 1 is a perspective view of an example of a movable truck positioned in a parked position in accordance with an illustrative embodiment of the brake, shear and cable management system and method disclosed herein.

Other advantages and features of the invention will be apparent from the following description and from the claims.

DETAILED DESCRIPTION OF THE INVENTION

The systems and methods discussed herein are merely illustrative of specific manners in which to make and use the invention and are not to be interpreted as limiting in scope.

While the systems and methods have been described with a certain degree of particularity, it is to be noted that many modifications may be made in the construction and the arrangement of the structural and function details disclosed herein without departing from the scope of the invention. It is understood that the invention is not limited to the embodiments set forth herein for purposes of exemplification.

The description of the invention is intended to be read in connection with the accompanying drawings, which are to be considered part of the entire written description of this invention. In the description, relative terms such as "front," "rear," "lower," "upper," "horizontal," "vertical," "inward," "outward," "up," "down," "top" and "bottom" as well as derivatives thereof (e.g., "horizontally," "downwardly," "upwardly" etc.) should be construed to refer to the orientation as then described or as shown in the drawings under discussion. These relative terms are for convenience of description and do not require that the device be constructed or the method to be operated in a particular orientation. Terms, such as "connected," "connecting," "attached," "attaching," "join" and "joining" are used interchangeably and refer to one structure or surface being secured to another structure or surface or integrally fabricated in one piece.

The invention relates to a brake, shear and cable management system and method, which is attachable adjacent to a rotatable drum. The system includes a cable management assembly, a cable brake assembly and a cable cutting assembly used in conjunction to manage, retain and sever a spent portion of cable upon the drum. A remote wired or wireless control system can allow the operator to be stationed in front of the drum, thereby reducing the risk of injury to personnel. For purposes of exemplification and not limitation, the drum is discussed and illustrated in the figures of the drawings as a drawworks mounted to a floor in an oil field drilling rig. In addition to drilling line, the inventive system and method can be used with line boring, electrical wire and cable, fiber optic cable or the like. The system and method disclosed herein are capable of pulling approximately 2,000 pounds (approximately 907 kg) at a rate of about 1 foot of cable per second, and provides an immediate and safe assembly to retain a cable wound upon the drum, a separate assembly for shearing the cable at a specific location upon the cable, and an assembly for managing the cable during periodic maintenance.

Figure 2:
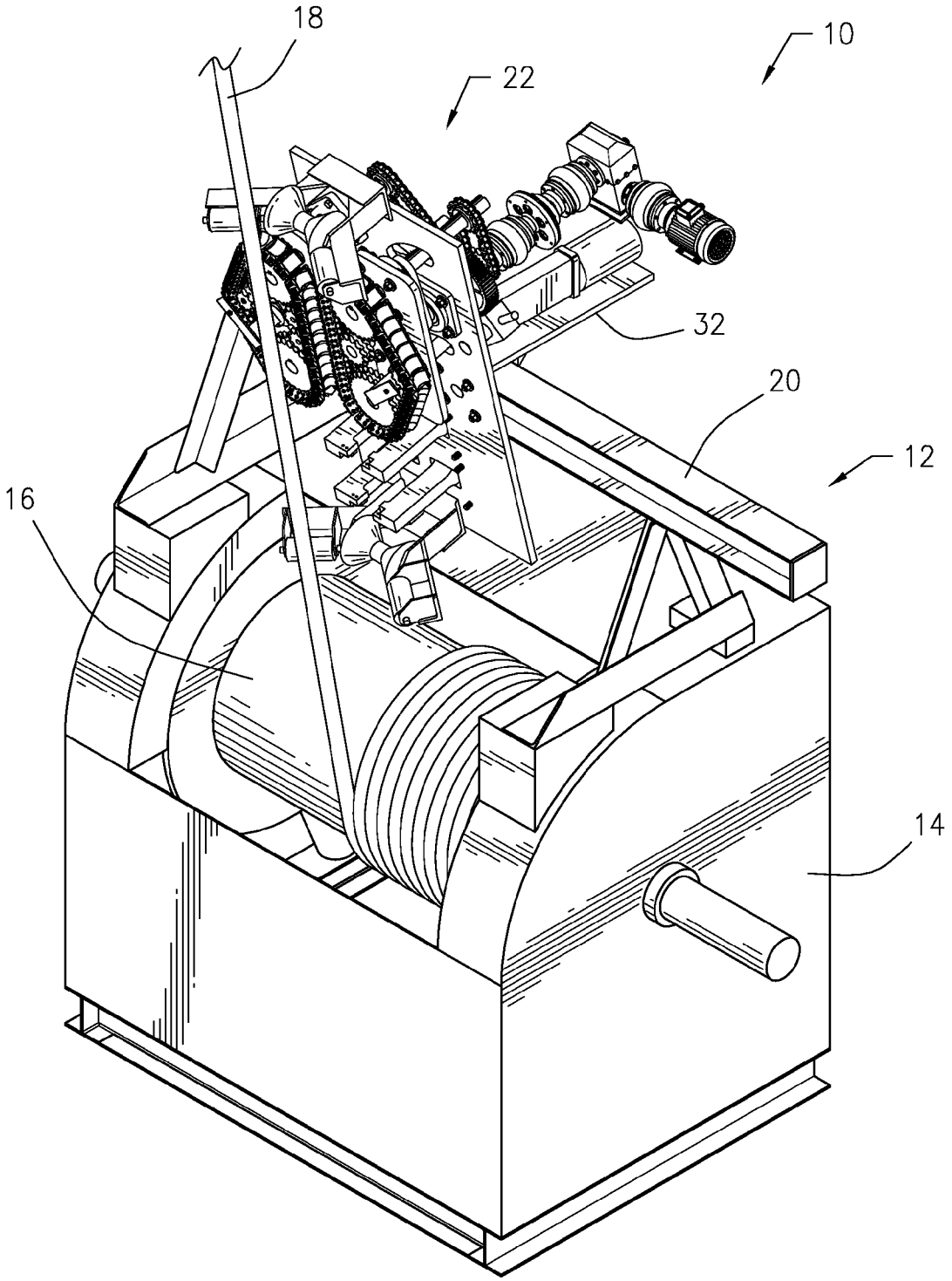
FIG. 2 is a perspective view of the movable truck shown in FIG. 1 positioned in a retracted position.
Figure 3:
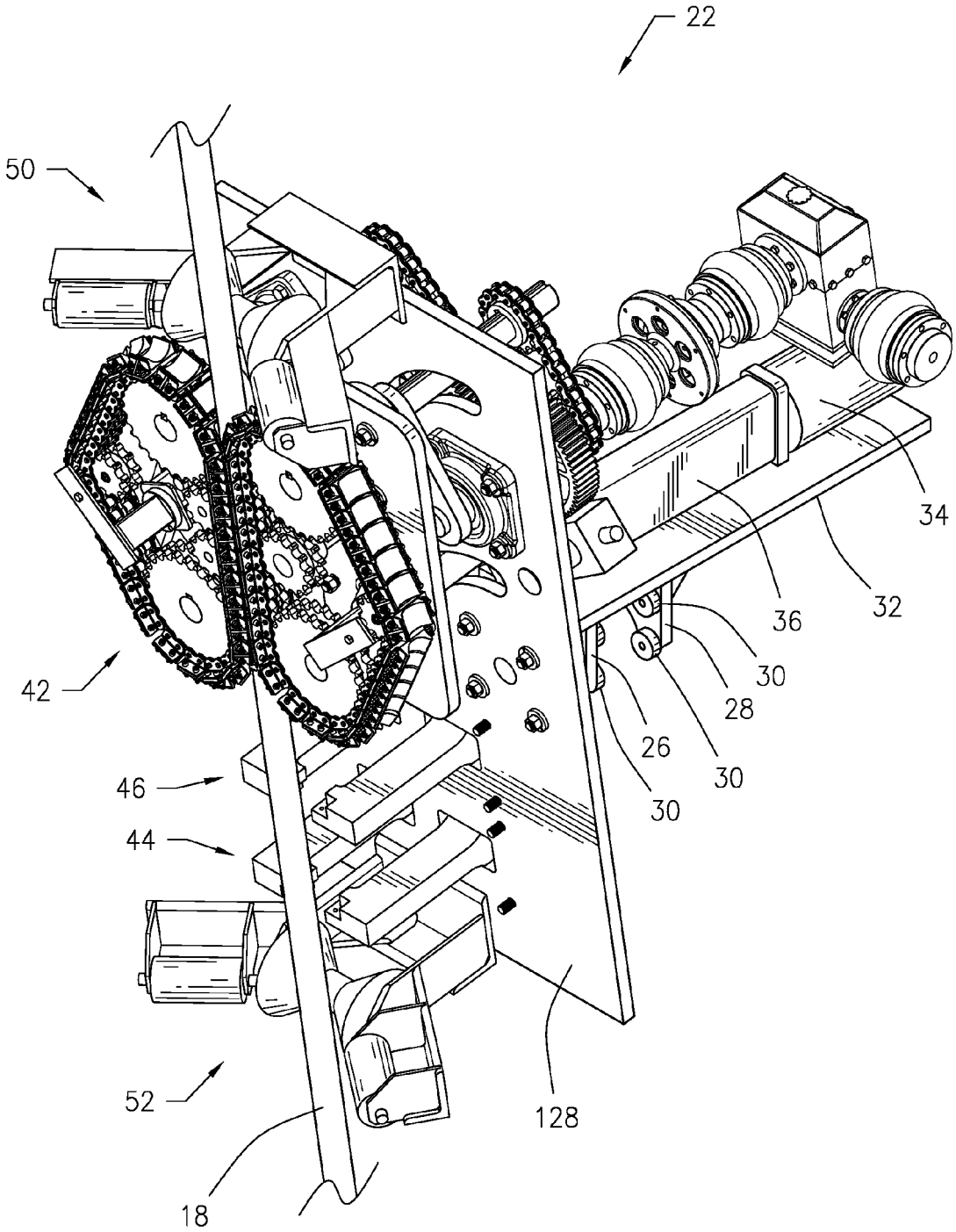
FIG. 3 is a perspective view of the movable truck shown in FIGS. 1 and 2 positioned in an engaged position.
Figure 4:
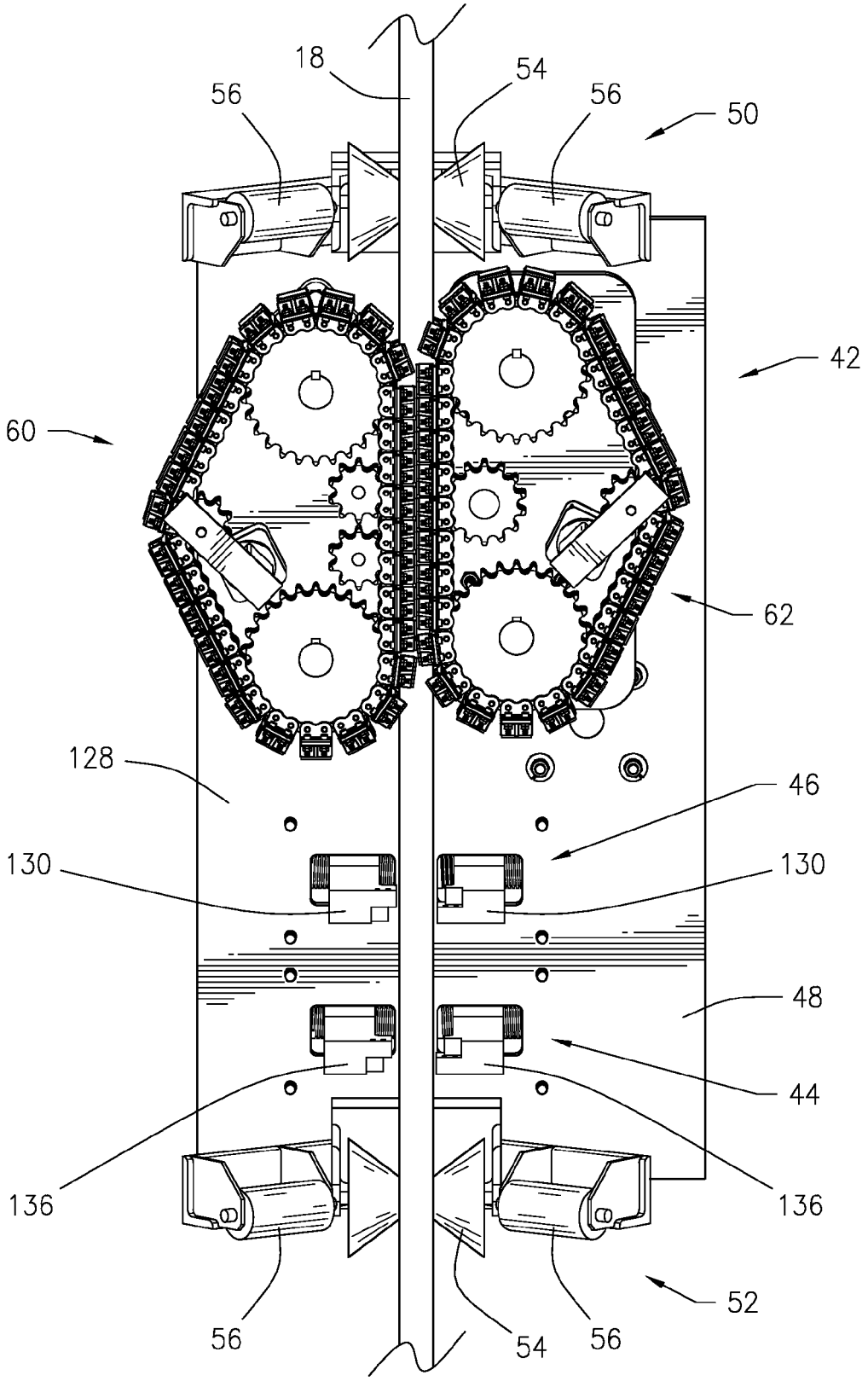
FIG. 4 is a front elevation view of the movable truck shown in FIGS. 1 through 3.
Figure 5:
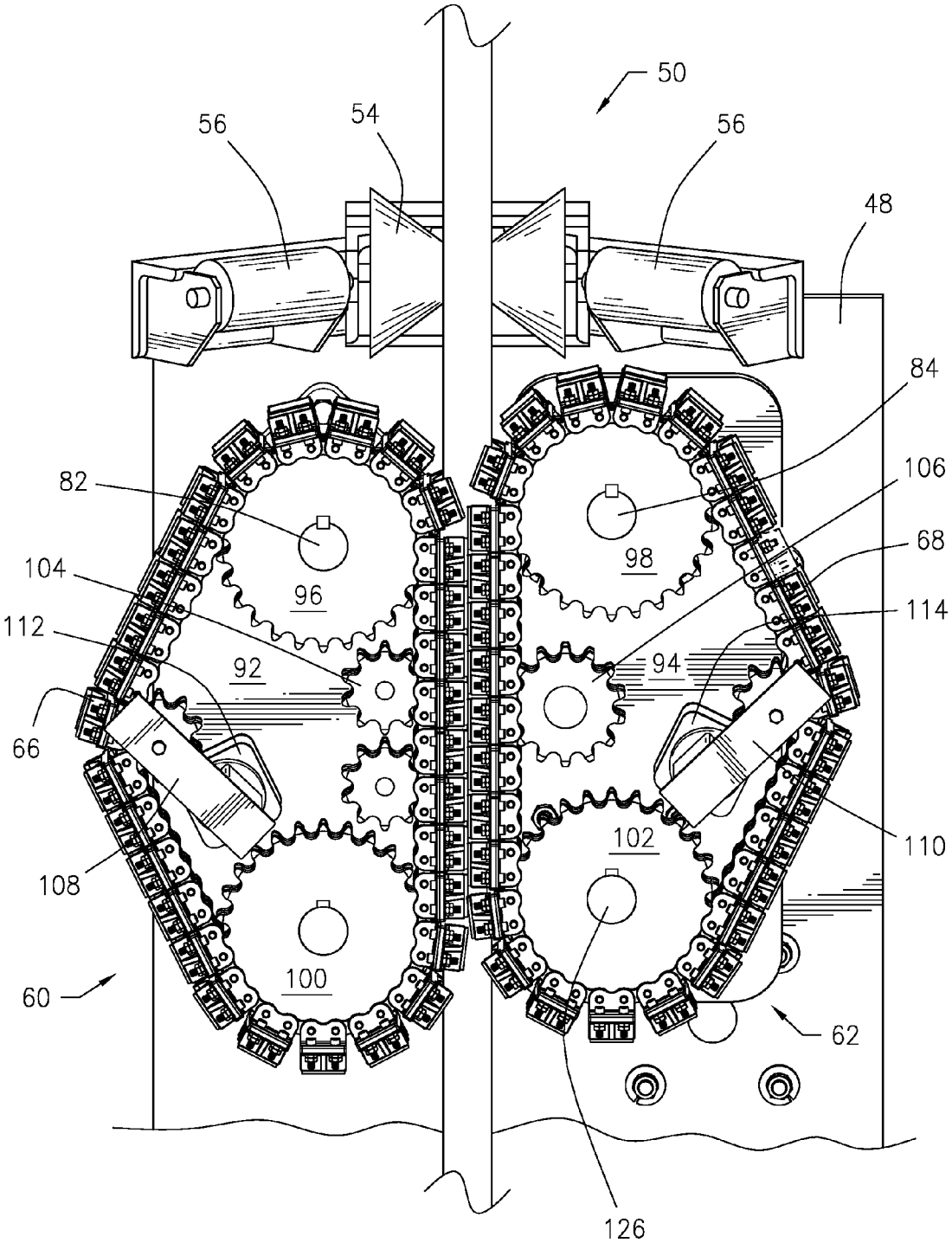
FIG. 5 is a front elevation view of an example of a cable management assembly in accordance with an illustrative embodiment of the brake, shear and cable management system and method disclosed herein.

Referring now to the figures of the drawings, wherein like numerals of reference designate like elements throughout the several views, and initially to FIGS. 1 through 3, the brake, shear and cable management system 10 includes a support structure 12 attached to an outer housing 14 of the drum 16 at a position that does not impeded the operation of the drum 16. The support structure 12 is constructed to allow both lateral and longitudinal movement of the system 10 in order for the cable 18 to spool and de-spool as intended during operation of the drum 16, such as during drilling operations. The support structure 12 includes a lateral guide assembly 20 for a movable truck 22. The movable truck 22 may be mounted to a truck 24 that rolls along the lateral guide assembly 20 between a parked position shown in FIG. 1 and a retracted position shown in FIG. 2. The truck 24 can be constructed as a front truck assembly 26 and a rear truck assembly 28, each having four block/rail wheels 30, positioned within the web and engaged with the flanges of the guide assembly 20 for lateral movement of the movable truck 22 during operation. Although the lateral guide assembly 20 is illustrated as a track of I-beam, a person having skill in the art will appreciate that the lateral guide assembly 20 can be constructed otherwise in order to provide the necessary stability to the system 10. For example, the lateral guide assembly 20 may be constructed using square tubing, rounded tubing or other type of beam or track that provides a smooth lateral pathway upon which the movable truck 22 traverses.

Figure 6:
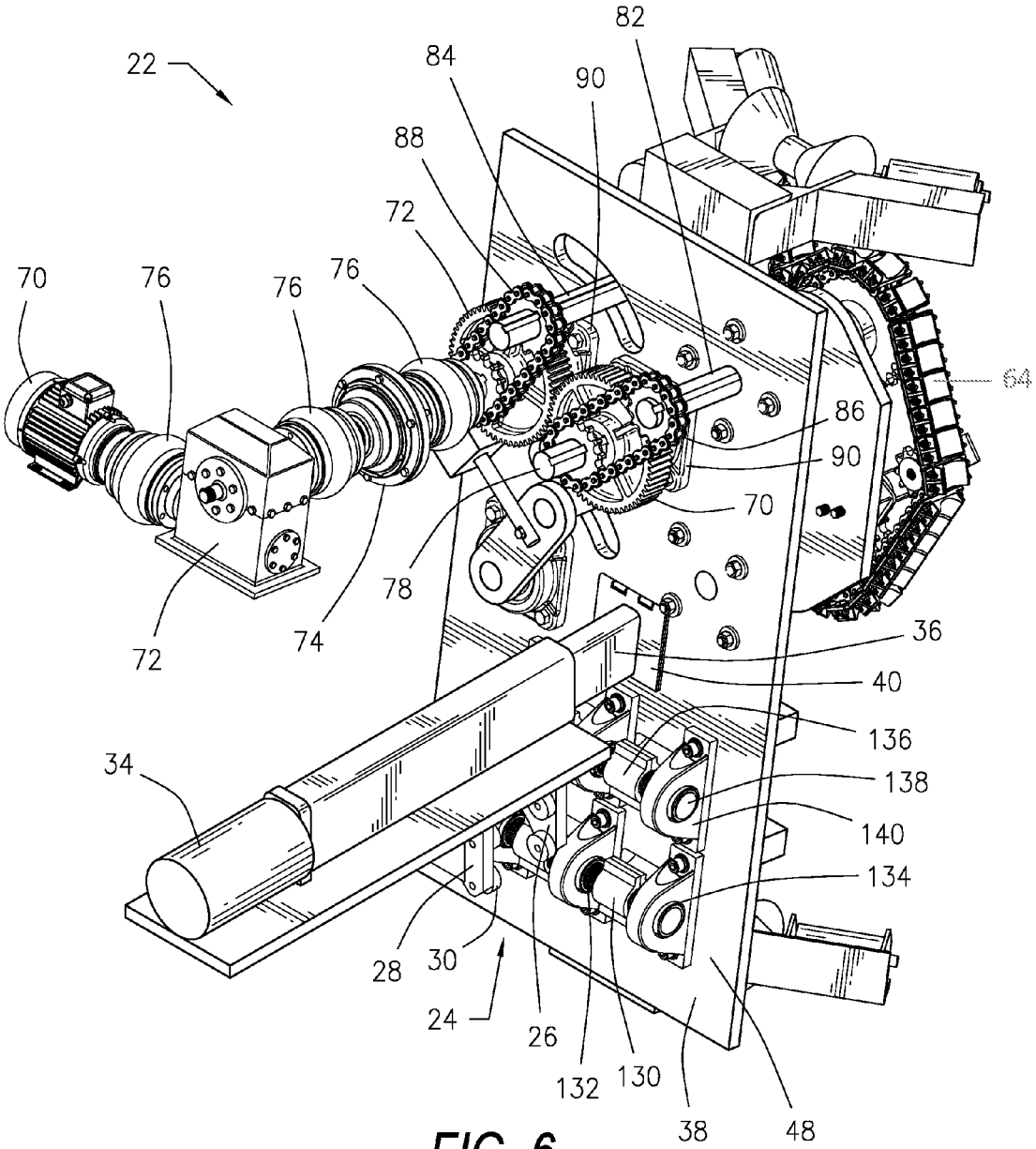
FIG. 6 is a first rear perspective view of the movable truck shown in FIG. 3.
Figure 7:
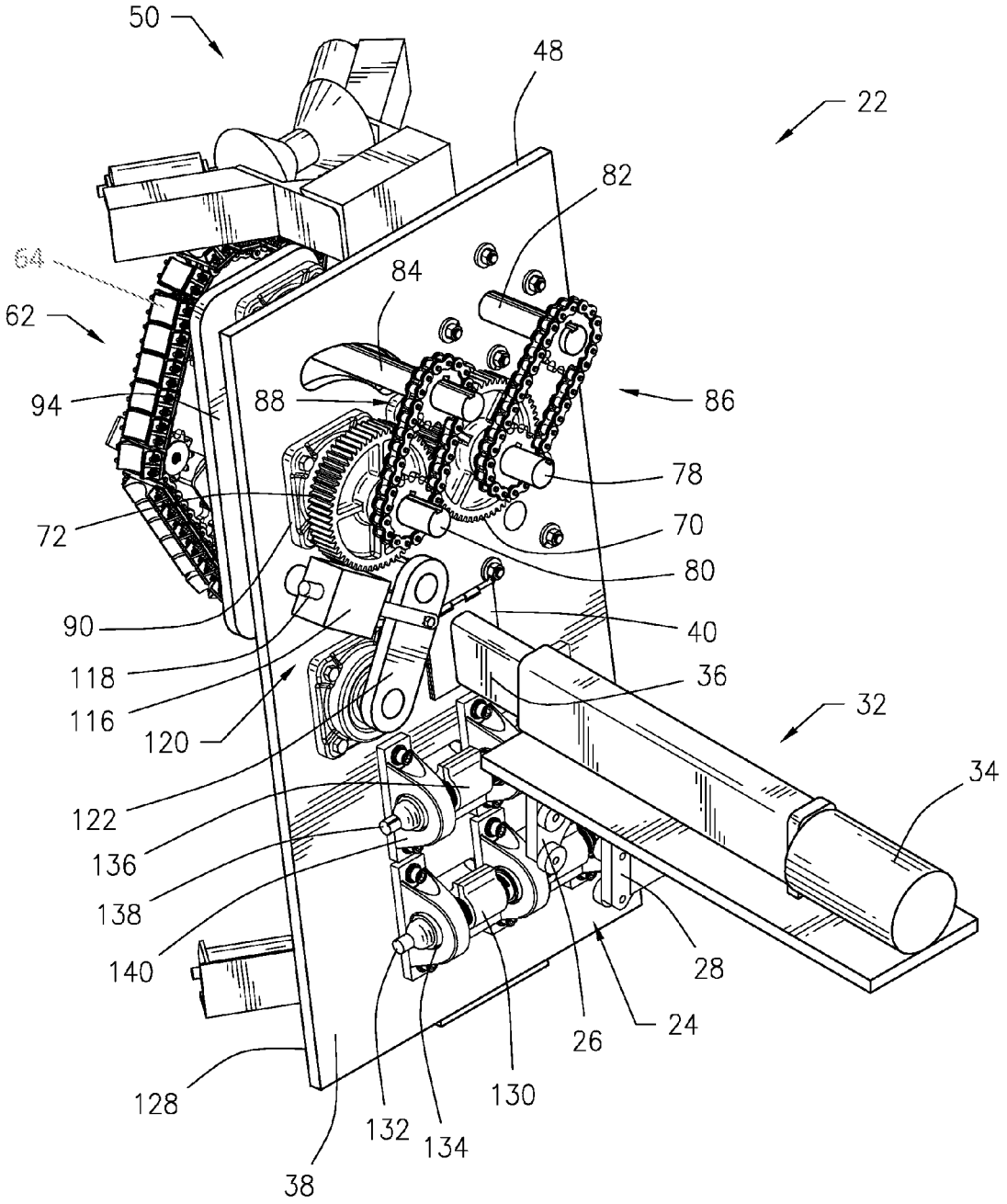
FIG. 7 is a second rear perspective view of the movable truck shown in FIG. 3.
Figure 8:
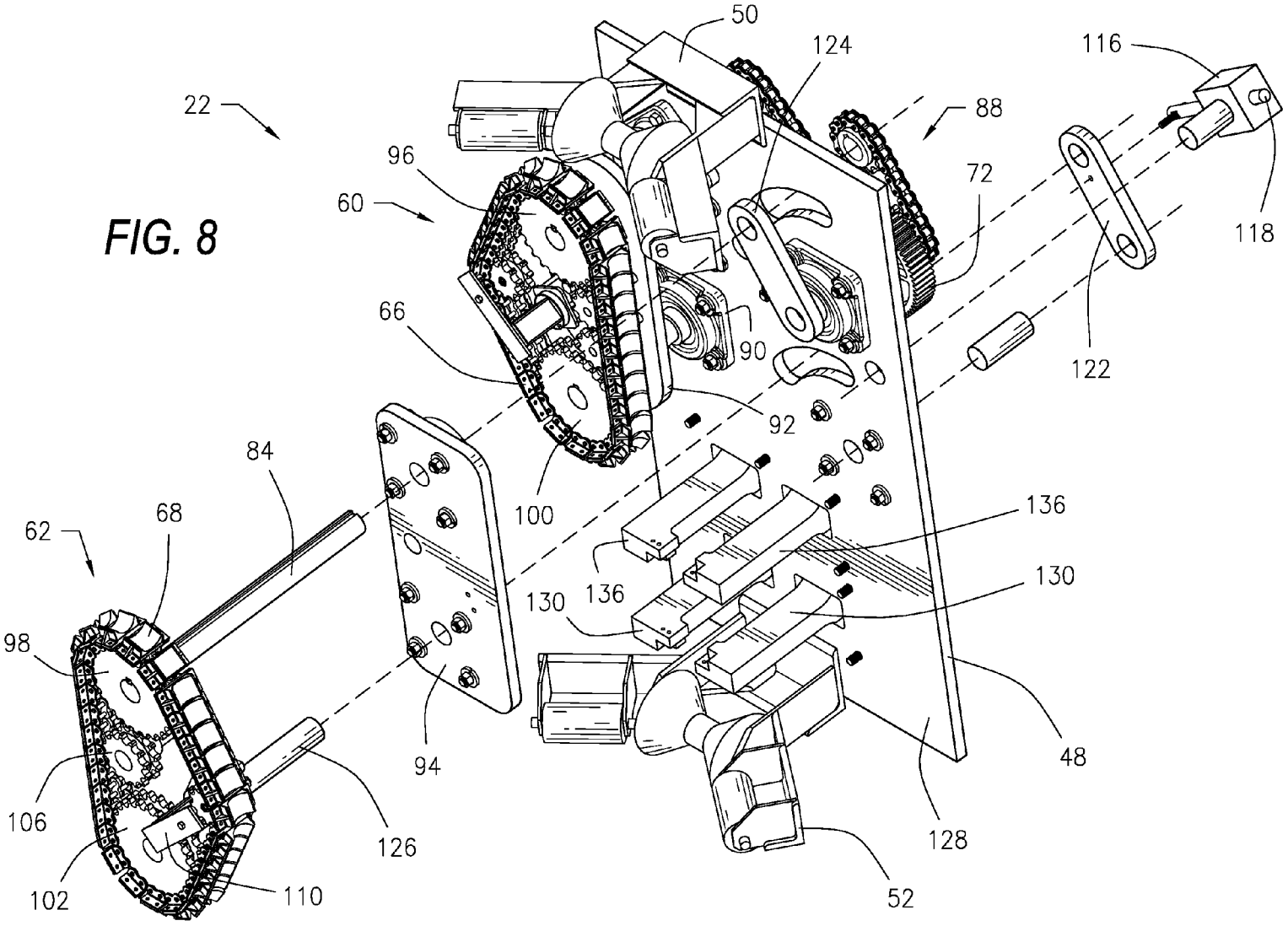
FIG. 8 is a partially exploded view of the movable truck shown in FIG. 3.
Figure 9:
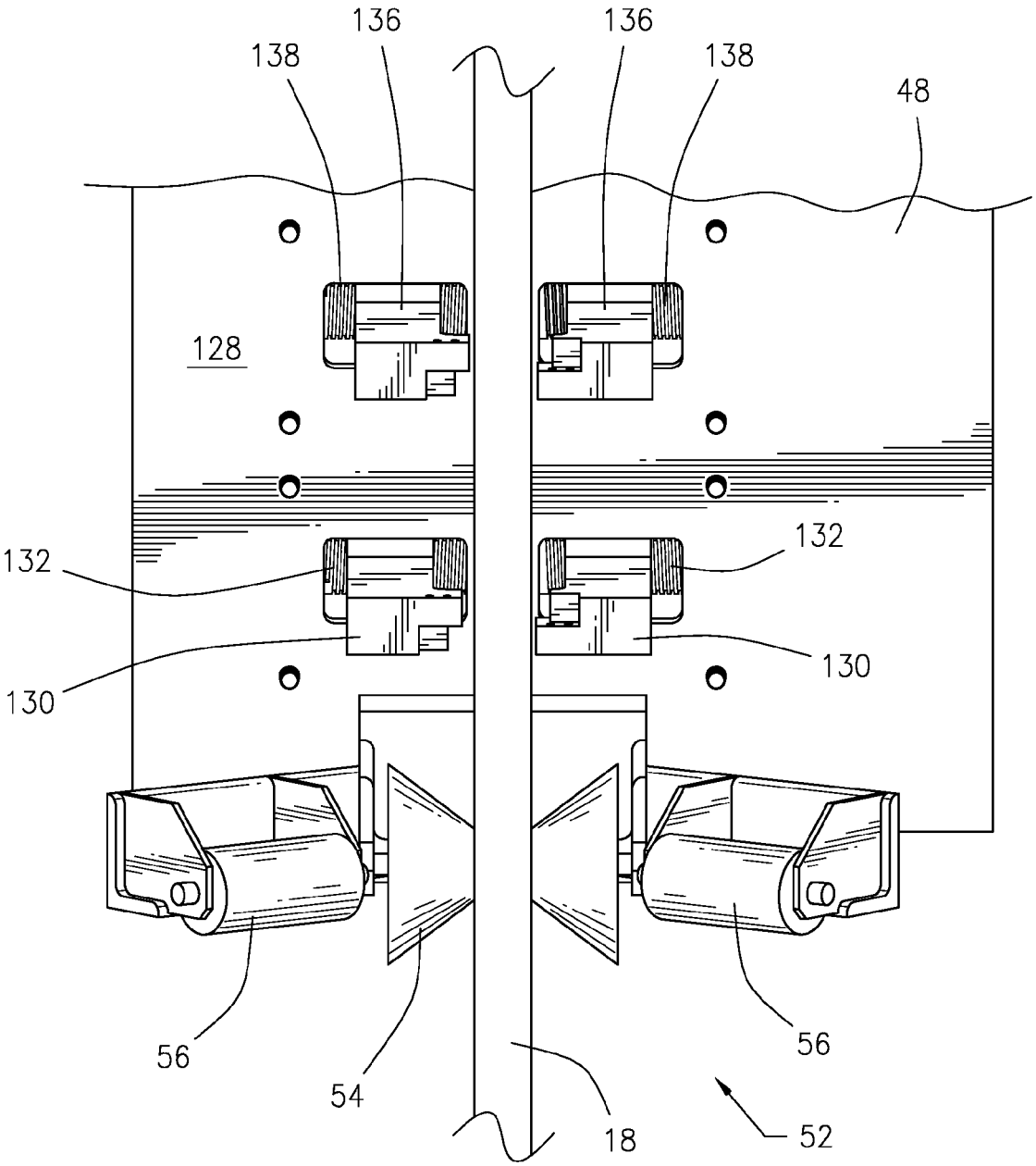
FIG. 9 is a front elevation view of an example of a cable brake assembly and a cable cutting assembly in accordance with an illustrative embodiment of the brake, shear and cable management system and method disclosed herein.

In addition to the lateral guide assembly 20, the support structure 12 includes a longitudinal guide assembly 32 for the movable truck 22 of the system 10. As can be clearly seen in FIGS. 3, 6 and 7, the longitudinal guide assembly 32 may include a motor 34 or other power source engaged with a telescoping tube 36; however, the system 10 is not so limited as other powered actuators and/or screw drives may be utilized for longitudinal movement the movable truck 22 between the retracted position illustrated in FIG. 2 and an engaged position illustrated in FIG. 3. Moreover, the longitudinal guide assembly 32 can be attached to a rear portion 38 of the movable truck 22 using a hinged connection 40 enabling the movable truck 22 to pivot about the vertical axis in order to align the cable 18 with the movable truck 22 as necessary during operation of the system 10.

The movable truck 22 of the system 10 includes the cable management assembly 42, the cable brake assembly 44 and the cable cutting assembly 46 mounted to a movable truck support plate 48. The movable truck 22 includes an upper set of guide rollers 50 and a lower set of guide rollers 52 separated by the cable management assembly 42, the cable brake assembly 44 and the cable cutting assembly 46. As exemplified in the figures of the drawings, each of set of guide rollers 50, 52 includes a wedge roller 54 positioned intermediate of a pair of cylindrical rollers 56, which are angled in relation to the wedge roller 54 in order to form a generally V-shaped opening. The upper set of guide rollers 50 and the lower set of guide rollers 52 aid in aligning and positioning the cable 18 in the cable management assembly 42, the cable brake assembly 44 and the cable cutting assembly 46 in order to effectively manage, retain and sever a spent portion of the cable 18.

Turning now to FIGS. 4 through 8, the cable management assembly 42 includes a pair of opposing crawler assemblies 60, 62 that engage and hold the cable so the brake assembly 44 can hold the cable 18 while the cutting assembly 46 severs the cable 18. Each crawler assembly 60, 62 cradles approximately one-third of the side of the cable 18 along an extended span of the cable 18. The crawler assemblies 60, 62 press on the cable 18 from two sides and are capable of pulling up or down with about 2,000 pounds of force at a rate of about 1-foot per second. As exemplified for use with drilling line, the crawler assemblies 60, 62 have brass or bronze U-blocks 64; however, the system may utilize other types, styles and forms of blocks, such as rubber blocks, if the cable is an electrical line or fiber optic cable.

The crawler assemblies 60, 62 include drive chains 66, 68 engaged with oppositely rotating spur gears 70, 72 to turn the crawler assemblies 60, 62. A motor 70 with a gear reducer 72, a friction clutch 74 and drive shaft couplers 76 power gear shafts 78, 80 that engage the spur gears 70, 72. The rotation of the spur gears 70, 72 is transmitted to drive shafts 82, 84 using roller chain sprocket assemblies 86, 88. A person having skill in the art will appreciate that each drive shaft 82, 84 could be separately powered by a motor or an actuator. Each of the rotating gear shafts 78, 80 and drive shafts 82, 84 may be respectively journaled in bearings 90, such as flange or pillow block bearings, which are mounted to the movable truck support plate 48 and/or sprocket plates 92, 94 in a parallel, spaced relation. As exemplified in the drawings, the drive chains 66, 68 are double link drive chains respectively engaged with upper drive sprockets 96, 98, which in turn are respectively engaged with the rotating drive shafts 82, 84. The crawler assemblies 60, 62 also include lower idler sprockets 100, 102 respectively engaged with the drive chains 66, 68. The upper drive sprockets 96, 98 are in a parallel, spaced relation with the lower idler sprockets 100, 102, which are separated by return sprockets 104, 106 that are engaged with the drive chains 66, 68. In addition, the crawler assemblies 60, 62 can include chain tensioners 108, 110 engaged with the drive chains 66, 68 and are respectively mounted to the sprocket plates 92, 94 using tensioner brackets 112, 114. The chain tensioners 108, 110 can be positioned intermediate of and offset from the drive sprockets 96, 98 and the idler sprockets 100, 102.

In order to open and close the crawler assemblies 60, 62 about the cable 18, a worm gear drive 116 with a screw shaft 118 powered by an electric motor or the like (not shown) is engaged with a linkage 120 to cause one crawler assembly 62 to move with respect to the other crawler assembly 60. As illustrated in the drawings, the linkage 120 is a four bar linkage that pivots one of the crawler assemblies 62 about an arc using a first rocker arm 122 and a second rocker arm 124. The first rocker arm 122 is engaged with an idler shaft 126, which in turn is engaged with the idler sprocket 102 of the movable crawler assembly 62. Similarly, the second rocker arm 124 is engaged with the drive shaft 84 journaled with the drive sprocket 98 and the roller chain sprocket assembly 88. The inventive system and method 10 is not limited to a four bar linkage and other types of linkages can be utilized; for example, the linkage 120 can be any mechanical or linear linkage, such as utilizing screw drives to control the tension along the cable 18 or a linkage that pivots the crawler assemblies 60, 62 at forty-five (45) degree angles in relation to the cable 18 so that when the cable 18 is pulled downwardly, the crawler assemblies 60, 62 are tightened for additional grip of the cable 18. As such, while the system 10 is exemplified in the drawings with the crawler assembly 60 being fixed and the crawler assembly 62 being movable, this arrangement could be reversed or both crawler assemblies 60, 62 could be movable in keeping with the scope of the system and method 10 disclosed herein.

As can be seen in FIGS. 4, 6, 7 and 9, the cable brake assembly 44 is connected to a front portion 128 of the movable truck support plate 48 intermediate of the lower set of guide rollers 52 and the cable cutting assembly 46. The cable brake assembly 44 includes a pair of opposing brake arms 130 made of a hard material with a gripper (not shown) mounted to the brake arms 130. The gripper can be constructed of a softer material, such as a resilient rubber, plastic or any other natural or unnatural material (e.g., nylon, polyethylene, etc.). The brake arms 130 may be engaged with and actuated by a screw drive shaft 132 journaled within bearings 134 attached to the rear portion 38 of the movable truck support plate 48 and powered to an electric motor or the like (not shown). A person having skill in the art will appreciate that the system 10 may utilize other constructions of the cable brake assembly 44.

In addition, the cable cutting assembly 46 is mounted to the movable truck support plate 48 intermediate of the crawler assemblies 60, 62 and the brake assembly 44. With the cable 18 being engaged on the rig side of the system 10 by the crawler assemblies 60, 62 and held on the drum side of the system 10 by the cable brake assembly 44, the cable 18 may be securely severed and the worn cable 18 wrapped about the drum 14 can be replaced. Similar to the brake assembly 44, the cable cutting assembly 46 may include a pair of opposing cutter arms 136 protruding from the front portion 128 of the movable truck 22 and actuated by a powered screw drive 138 that is journaled in bearings 140 attached to the rear portion 38 of the movable truck support plate 48. The cutter arms 136 may include a formed notch and an opposing shear cutting blade, which is forced against and within the formed notch to completely sever the entire diameter of cable 18 at a selected point.

A method for using this brake, shear and cable management system 10 is also contemplated within the scope of this disclosure. During operation, the movable truck 22 is moved from the parked position shown in FIG. 1 to the retracted position shown in FIG. 2, and then to the engaged position shown in FIG. 3. The upper set of guide rollers 50 and the lower set of guide rollers 52 aid in positioning the cable 18 within the crawler assemblies 60, 62, the brake assembly 44 and the cutting assembly 46, and the crawler assemblies 60, 62 are actuated in order to engage the cable 18. The crawler assemblies 60, 62 pull the cable 18 to align the desired shearing position of the cable 18 with the cutting assembly 46, at which point the brake assembly 44 engages the cable 18. Once the cable 18 is securely retained by the crawler assemblies 60, 62 and the brake assembly 44, the cutting assembly 46 can be actuated in order to sever the cable 18 at the desired location. The spent portion of cable 18 on the drum side of the system 10 may then be removed from the drum 14, and the spent portion of cable 18 can be disposed of and a new portion of cable 18 can be spliced in using techniques readily known to those having skill in the art. Subsequently, the crawler assemblies 60, 62 pull the cable 18 from the rig side of the system 10 until a desired amount of cable 18 is on the drum side of the system 10. The cable 18 can then be reattached to and wound about the drum 14, and the crawler assemblies 60, 62 can remove any additional slack in the cable 18. The crawler assemblies 60, 62 are then released from the cable 18, and the movable truck 22 moves the support structure 12 from the engaged position, to the retracted position and ultimately to the parked position, allowing the operations to continue.

Whereas, the system and methods have been described in relation to the drawings and claims, it should be understood that other and further modifications, apart from those shown or suggested herein, may be made within the scope of the invention.

What is claimed is:

1. A brake, shear and cable management system attachable adjacent to a rotatable drum to manage, retain and sever a spent portion of cable, said system comprising:

a movable truck mounted to a support structure, said support structure constructed to laterally move said movable truck between a parked position and a retracted position, and said support structure further constructed to longitudinally move said movable truck between said retracted position and an engaged position;

a cable management assembly mounted to said movable truck, said cable management assembly comprising a plurality of crawler assemblies, said crawler assemblies further comprising drive chains engaged with oppositely rotating gears, said gears engaged with gear shafts powered by a motor;

a cable brake assembly mounted to said movable truck;

a cable cutting assembly mounted to said movable truck intermediate of said cable brake assembly and said cable management assembly; and a plurality of guide rollers attached to said movable truck.

2. The system of claim 1 wherein said support structure further comprises a lateral guide assembly and a longitudinal guide assembly.

3. The system of claim 2 further comprising said movable truck having a truck assembly engaged with said lateral guide assembly for lateral movement of said movable truck between said parked position and said retracted position.

4. The system of claim 2 wherein said lateral guide assembly further comprises I-beam, square tubing or rounded tubing.

5. The system of claim 2 wherein said longitudinal guide assembly further comprises powered actuators and/or screw drives for longitudinal movement of said movable truck between said retracted position and said engaged position.

6. The system of claim 5 where said longitudinal guide assembly further comprises a motor engaged with a telescoping tube.

7. The system of claim 2 wherein said longitudinal guide assembly is hingedly connected to said movable truck.

8. The system of claim 1 where said plurality of guide rollers further comprises an upper set of guide rollers and a lower set of guide rollers separated by said cable management assembly, said cable brake assembly and the cable cutting assembly.

9. The system of claim 1 wherein said plurality of guide rollers further comprises at least one wedge roller and at least one cylindrical guide roller.

10. The system of claim 9 wherein said cylindrical guide roller is a pair of cylindrical guide rollers, and wherein said pair of cylindrical guide rollers are angled in relation to said at least one wedge roller to form a generally V-shaped opening.

11. The system of claim 1 wherein said crawler assemblies further comprise brass or bronze U-blocks or rubber blocks attached to said drive chain.

12. The system of claim 1 further comprising a gear reducer, a friction clutch and drive shaft couplers engaged with said motor.

13. The system of claim 1 further comprising said gears being engaged with drive shafts, said drive shafts being engaged with drive sprockets, and said drive sprockets being engaged with said drive chains of said crawler assemblies.

14. The system of claim 13 wherein said drive shafts and/or said gear shafts are respectively journaled in bearings mounted to said movable truck.

15. The system of claim 13 further comprising idler sprockets engaged with said drive chains of said crawler assemblies.

16. The system of claim 15 further comprising chain tensioners and/or return sprockets engaged with said drive chains of said crawler assemblies.

17. The system of claim 1 wherein said plurality of crawler assemblies further comprises a pair of opposing crawler assemblies mounted to said movable truck intermediate of said guide rollers and said cable cutting assembly.

18. The system of claim 17 wherein said cable management system further comprises an actuator engaged with a linkage to cause one crawler assembly to directionally move towards or away from the other crawler assembly.

19. The system of claim 18 wherein said linkage is a four bar linkage or a linear linkage.

20. The system of claim 1 wherein said cable brake assembly is mounted to said movable truck intermediate of said guide rollers and said cable cutting assembly.

21. The system of claim 1 wherein said cable brake assembly further comprises protruding brake arms having a cable gripper.

22. The system of claim 21 wherein said brake arms are actuated by a powered screw drive journaled in bearings mounted to said movable truck.

23. The system of claim 1 wherein said cable cutting assembly further comprising protruding cutter arms having a cable severer.

24. The system of claim 23 wherein said cutter arms are actuated by a powered screw drive journaled in bearings mounted to said movable truck.

25. A brake, shear and cable management system, comprising:

a movable truck mounted to a support structure, said support structure comprising a lateral guide assembly and a longitudinal guide assembly;

a cable management assembly mounted to said movable truck, said cable management assembly comprising a plurality of crawler assemblies, each of said crawler assemblies further comprising U-blocks or rubber blocks attached to a drive chain; and a cable cutting assembly mounted to said movable truck.

26. The system of claim 25 wherein said lateral guide assembly is constructed to laterally move said movable truck between a parked position and a retracted position, and wherein said longitudinal guide assembly is constructed to longitudinally move said movable truck between said refracted position and an engaged position.

27. The system of claim 26 further comprising said movable truck having a truck assembly engaged with said lateral guide assembly for lateral movement of said movable truck between said parked position and said retracted position.

28. The system of claim 26 where said longitudinal guide assembly further comprises a motor engaged with a telescoping tube.

29. The system of claim 26 wherein said longitudinal guide assembly is hingedly connected to said movable truck.

30. The system of claim 25 further comprising a plurality of guide rollers attached to said movable truck.

31. The system of claim 30 where said plurality of guide rollers further comprises an upper set of guide rollers and a lower set of guide rollers separated by said cable management assembly and the cable cutting assembly.

32. The system of claim 31 wherein said plurality of guide rollers further comprises at least one wedge roller and at least one cylindrical guide roller.

33. The system of claim 25 wherein said crawler assemblies further comprise brass or bronze U-blocks or said rubber blocks attached to drive chain engaged with oppositely rotating gears, said gears engaged with gear shafts powered by a motor.

34. The system of claim 33 further comprising chain tensioners, idler sprockets and/or return sprockets engaged with said drive chains of said crawler assemblies.

35. The system of claim 25 wherein said plurality of crawler assemblies further comprises a pair of opposing crawler assemblies mounted to said movable truck.

36. The system of claim 35 wherein said cable management system further comprises an actuator engaged with a linkage to cause one crawler assembly to directionally move towards or away from the other crawler assembly.

37. The system of claim 25 further comprising a cable brake assembly mounted to said movable truck.

38. The system of claim 37 wherein said cable brake assembly further comprises a cable gripper.

39. The system of claim 37 wherein said cable cutting assembly is mounted to said movable truck intermediate of said cable management assembly and said cable brake assembly.

40. The system of claim 37 wherein said cable brake assembly is mounted to said movable truck intermediate of guide rollers and said cable cutting assembly.

41. The system of claim 25 wherein said cable cutting assembly further comprising a cable severer.

42. A brake, shear and cable management system, comprising:

a movable truck mounted to a support structure, said support structure comprising a lateral guide assembly and a longitudinal guide assembly;

a cable management assembly mounted to said movable truck, said cable management assembly comprising a plurality of crawler assemblies;

a cable brake assembly mounted to said movable truck;

a cable cutting assembly mounted to said movable truck;

a plurality of guide rollers attached to said movable truck;

wherein said cable cutting assembly is mounted to said movable truck intermediate of said cable management assembly and said cable brake assembly; and wherein said cable brake assembly is mounted to said movable truck intermediate of guide rollers and said cable cutting assembly.

43. The system of claim 42 wherein said lateral guide assembly is constructed to laterally move said movable truck between a parked position and a retracted position, and wherein said longitudinal guide assembly is constructed to longitudinally move said movable truck between said refracted position and an engaged position.

44. The system of claim 43 further comprising said movable truck having a truck assembly engaged with said lateral guide assembly for lateral movement of said movable truck between said parked position and said retracted position.

45. The system of claim 42 where said longitudinal guide assembly further comprises a motor engaged with a telescoping tube.

46. The system of claim 42 wherein said longitudinal guide assembly is hingedly connected to said movable truck.

47. The system of claim 42 where said plurality of guide rollers further comprises an upper set of guide rollers and a lower set of guide rollers separated by said cable management assembly and the cable cutting assembly.

48. The system of claim 47 wherein said plurality of guide rollers further comprises at least one wedge roller and at least one cylindrical guide roller.

49. The system of claim 42 wherein said crawler assemblies further comprise brass or bronze U-blocks or rubber blocks attached to drive chains engaged with oppositely rotating gears, said gears engaged with gear shafts powered by a motor.

50. The system of claim 49 further comprising chain tensioners, idler sprockets and/or return sprockets engaged with said drive chains of said crawler assemblies.

51. The system of claim 49 wherein said plurality of crawler assemblies further comprises a pair of opposing crawler assemblies mounted to said movable truck.

52. The system of claim 51 wherein said cable management system further comprises an actuator engaged with a linkage to cause one crawler assembly to directionally move towards or away from the other crawler assembly.

53. The system of claim 42 wherein said cable brake assembly further comprises a cable gripper.

54. The system of claim 42 wherein said cable cutting assembly further comprising a cable severer.

* * * * *